United States Patent [19]

Pedersen et al.

[11] Patent Number: 4,811,677

[45] Date of Patent: Mar. 14, 1989

[54] RIG FOR A SAIL CARRYING BOAT

[75] Inventors: Mogens Pedersen, Egå ; Günther Wiesel, Åbenrå ; Niels Brenholdt, Rønde, all of Denmark

[73] Assignee: MP-Sejl A/S, Egå , Denmark

[21] Appl. No.: 4,636

[22] Filed: Jan. 20, 1987

[30] Foreign Application Priority Data

Jan. 17, 1986 [DK] Denmark ..... 252/86

[51] Int. Cl.[4] ..... B63H 9/04

[52] U.S. Cl. ..... 114/89; 114/106

[58] Field of Search ..... 114/39.1, 102, 103, 114/104, 105, 106, 107, 108

[56] References Cited

U.S. PATENT DOCUMENTS

| | | | |
|---|---|---|---|
| 2,565,219 | 8/1951 | Gardiner et al. | 114/103 |
| 3,260,230 | 7/1966 | Kavert | 114/106 |
| 3,759,210 | 9/1973 | Davis | 114/108 |
| 4,061,101 | 12/1977 | Cook | 114/106 |
| 4,116,152 | 9/1978 | Larsson | 114/106 |
| 4,211,179 | 7/1980 | Saunders | 114/105 |
| 4,480,570 | 11/1984 | Rosenfield | 114/90 |

FOREIGN PATENT DOCUMENTS

| | | |
|---|---|---|
| 0011582 | 11/1979 | European Pat. Off. . |
| 2658801 | 4/1980 | Fed. Rep. of Germany . |

*Primary Examiner*—Joseph F. Peters, Jr.
*Assistant Examiner*—Edwin L. Swinehart
*Attorney, Agent, or Firm*—Watson, Cole, Grindle & Watson

[57] ABSTRACT

A rig for a sail-carrying boat comprises a mast having an axially-extending luff track, a sail having a bead-shaped luff formed by a longitudinally folded flat ribbon sewn to the front edge of the sail cloth, the bead-shaped luff being inserted in the luff track, and a boom secured to the mast by a pivotable joint, the boom including a tubular body and a rod rotatably mounted in the tubular body and to which the bottom edge of the sail is secured, such that rotation of the rod during reefing causes the sail to be wrapped therearound.

7 Claims, 5 Drawing Sheets

RIG FOR A SAIL CARRYING BOAT

BACKGROUND OF THE INVENTION

This invention relates to a rig for a sail-carrying boat, the rig comprising a mast, a sail comprising a bead-shaped luff mounted in a luff track so as to be axially displaceable relative to the mast, and a rotatable boom secured to the mast by a pivotable joint and comprising means for securing the sail to the boom and means for rotating the boom so as to reef the sail.

A serious drawback of a rib of the above-mentioned type is that in reefing a sail comprising a conventional luff, the latter tends to be wound around the boom in the joint zone and the desired freedom of movement of the boom is reduced.

An attempt has been made to overcome this difficulty by providing a bolt rope tunnel extending from the top of the mast towards a point on the boom which is spaced from the mast and is located outside the joint zone, the bolt rope tunnel for the luff being connected with the mast by means of a connecting member, cf. European patent publication No. 0 011 582 A1.

During reefing, only that part of the sail which is located rearwardly of the connecting member is rolled on the boom and the luff is wound in a screw line along the boom.

The use of such a connecting member creates a new problem because the connecting member has to be reefed separately from the deck and consequently a reefing from the cockpit of the boat is impossible. Furthermore, by winding the luff on the boom in a screw line from the front end towards the rear end of the boom the center of the sail is displaced rearwardly, thus disturbing the setting of the sail.

SUMMARY OF THE INVENTION

The main object of the invention is to reduce such undesired changes of the aerodynamic shape and the setting of the sail during reefing of the sail.

Another object of the invention is to provide a rig with which such undesired changes during reefing can be counteracted.

A further object of the invention is to provide an improved rotatable boom.

A still further object of the invention is to store a reefed sail in such a manner that it is protected against the influence of weather and sun.

According to the present invention there is provided a rig comprising a sail having a luff constituted by a longitudinally folded flat ribbon and a filler of essentially circular cross-sectional shape provided between the folded parts of the ribbon so as to form a bead in the luff zone.

The invention is based on the discovery that by folding a flat ribbon having the same strength as that of a conventional fore leech and placing a filler as defined above between the folded parts of the ribbon, the luff thus obtained will be considerably thinner than a conventional luff but still sufficiently large to secure it in a leech track.

In a preferred embodiment of the rig of the invention also the leech of the sail comprises a longitudinally folded flat ribbon having a filler of essentially circular cross-sectional shape provided between the folded parts of the ribbon so as to form a bead in the leech zone.

Due to the reduced thickness of the luff and optionally the leech, there will be less piling up during reefing than with conventional leeches and consequently the setting of a reefed sail will be better than with a conventional sail.

The flat ribbon is preferably a woven or braided sheet material, e.g., consisting of synthetic fibres or filaments and having a thickness of from 0.1 mm to 1.0 mm and a width (in non-folded state) of from 80 mm to 200 mm.

The purpose of the filler, which preferably is made from an extruded plastic material, is to impart a bead shape to the edge of the sail.

The folded parts of the ribbon are preferably located on opposite sides of the sail and are attached thereto by sewing.

In another preferred embodiment of the rig of the invention, the rotatable boom comprises a hollow rod having a central hole and a surface comprising at least one undercut groove, the hollow rod being mounted on a shaft having secured thereto a reefing drum for rotating the rod and being mounted between two end plates of a rigid tubular body comprising at its upper side an axially-extending slot.

The undercut grooves provided in the surface of the hollow rod serve two functions. Firstly, they serve to enable the bottom edge of the sail to be secured to the hollow rod on which the sail is rolled during reefing.

Secondly, the undercut grooves permit filling elements to be secured to the hollow rod so as to impart to the reefed sail a desired aerodynamic shape.

The tubular body comprising the end plates between which the shaft supporting the hollow rod is mounted, forms an independent self-supporting unit which is linked to the mast by means of the above-mentioned pivotable joint and in which the reefed sail can be safely stored and protected against the influence of weather and sun.

In reefing, the hollow shaft is caused to rotate by means of the reefing drum, which is for example secured to the end of the hollow rod remote from the mast, e.g., by pulling a rope passing around suitable rope sheaves located below the hollow shaft at opposite ends thereof and preferably in a separate housing provided at the underside of the tubular body.

The shaft which is mounted between the two end plates of the tubular body may be a wire, wire rod or solid rod. At least one end of the shaft is preferably provided with a thread and a cooperating mutter for tensioning the wire or rod between the two end plates.

The slot porivded at the upper side of the tubular body is preferably laterally offset relative to the shaft so as to allow the sail to be reefed without diverting and abrading the sail.

The edges of the slot preferably comprises two opposite longitudinally-extending grooves serving as guides for a combined outhaul and slot cover ribbon of a length at least equal to the length of the tubular body and ending in an outhaul rope. In retracted state the ribbon extends from the slot at the upper side of the tubular body around the free end of the tubular body and along the underside of the tubular body.

The forward end of the ribbon is connected with an outhaul slider mounted slidably along the edges of the slot and supporting a leech feeder for the leech of the sail. Thus, after being reefed the sail can be stretched to an ideal setting by tightening the rope connected to the combined outhaul and slot cover ribbon. The combined outhaul and slot cover ribbon is preferably connected with a retaining spring having one end attached to the ribbon and having its opposite end connected to the tubular body so as to ensure that the outhaul slider is automatically moved rearwardly when the sail is unrolled from the boom.

The outhaul rope can be led to the cockpit or the bridge of the boat, thus allowing the operator to adjust the shape and setting of the sail without leaving the steering wheel and without stepping out on the deck. The reefing rope, sheet and halyard can likewise be led to the cockpit or bridge, whereby all sail operations can be performed by a single person who at the same time can steer the boat. Furthermore, by performing these operations from the cockpit or bridge, the risks involved in working on the deck can be avoided.

As will appear from the above explanation, the invention permits a continuous reefing of the sail to any desired position as opposed to the conventional reefing systems which only allow for roller reefing without outhaul of the sail or reefing in steps corresponding to the distance between the reefs or reefholes in the sail.

The retaining spring and part of the rope and the outhaul and slot cover ribbon are preferably located in the separate housing at the underside of the tubular body.

Since the forward end of the ribbon is connected with the after leech feeder, the slot at the upperside of the tubular body is gradually covered by the ribbon as the sail is reefed, thus closing the tubular body at the upper side and offering full protection for the sail.

The outhaul and slot cover ribbon is preferably made from a woven or braided material, e.g., consisting of synthetic fibres or filaments.

DESCRIPTION OF THE PREFERRED EMBODIMENTS

Figure 1:
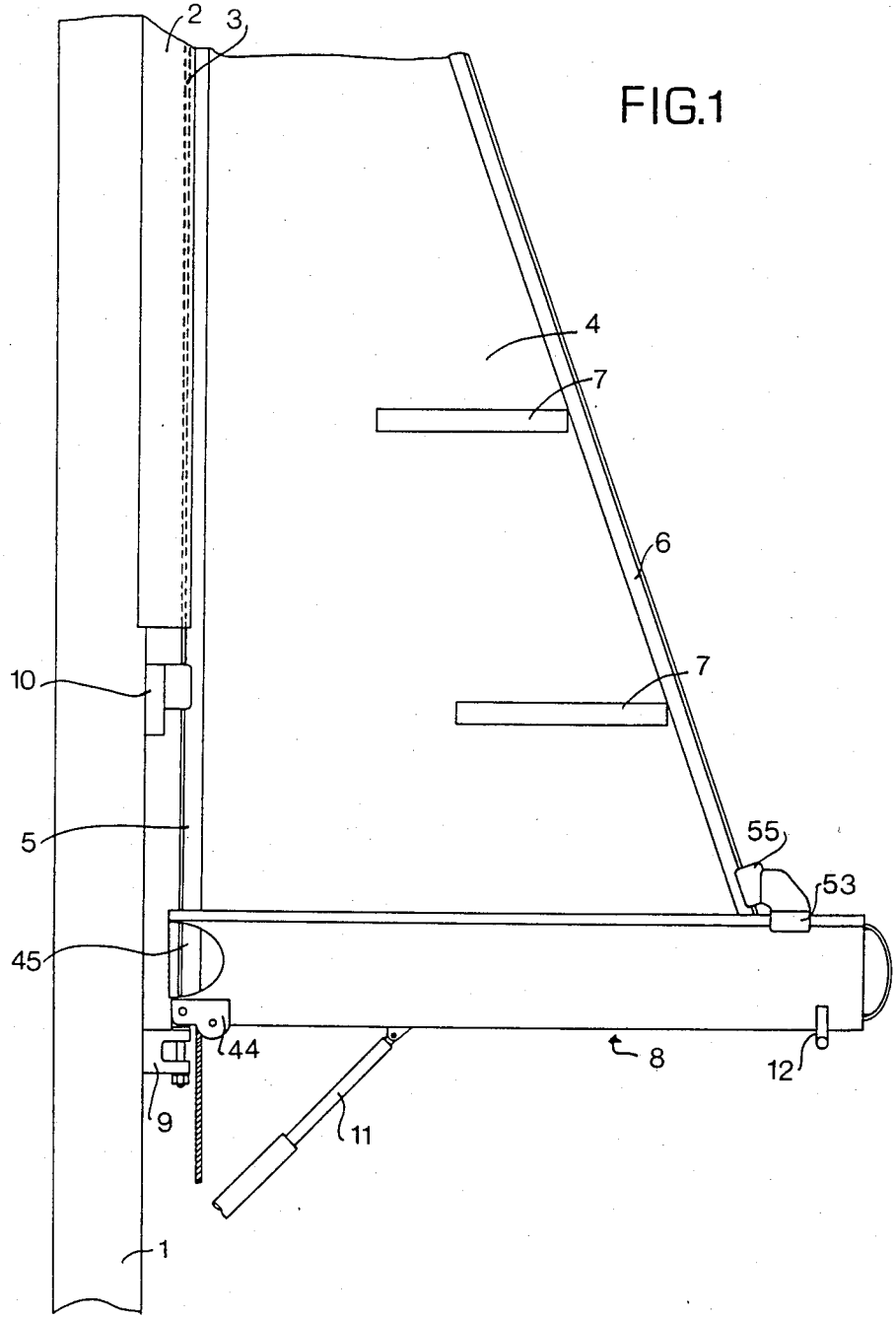
FIG. 1 is a side view of the lower part of a preferred embodiment of the rig of the invention.

The rig illustrated in FIG. 1 comprises a mast 1 comprising at its rear side an axially-extending metal profile 2 comprising a luff track 3. The rig further comprises a sail 4 having a luff 5 which will be described in further detail below and a similar leech 6. The sail 4 comprises horizontal pockets 7 sewn to the sail cloth and adapted to hold battens.

The rig further comprises a boom arrangement, generally referred to by the reference numeral 8. The front edge of the boom arrangement 8 is connected with the mast 1 by a goose neck joint 9.

A leech feeder 10 is secured to the mast 1 a short distance below the lower end of the metal profile 2. The boom arrangement 8 also comprises means for attaching thereto a kicking strip 11 and a mainsheet toggle 12.

Figure 2:
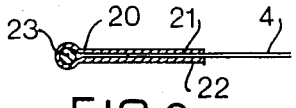
FIG. 2 is a cross-sectional view of the fore leech of the sail illustrated in FIG. 1.

As will appear from FIG. 2, the luff 5 of the sail 4 comprises a longitudinally folded ribbon 20, the folded parts 21 and 22 being attached to the edge of the sail cloth by sewing. A string 23 of a filler material is located between the folded parts so as to impart a bead shape to the folded ribbon 20.

The boom arrangement 8 comprises a rigid boom tube 30 having at its underside an inner wall 31 and an outer wall 32 defining therebetween a separate compartment 33. A rod 34 comprising four longitudinally-extending undercut grooves 35 is rotatably mounted on a wire rod 36 within the tube 30. The bottom edge of the sail is secured in one of the grooves 35 so that the sail 4 will be wound on the rod 34 when the hollow rod 34 is rotated as will be explained below.

Figure 4:
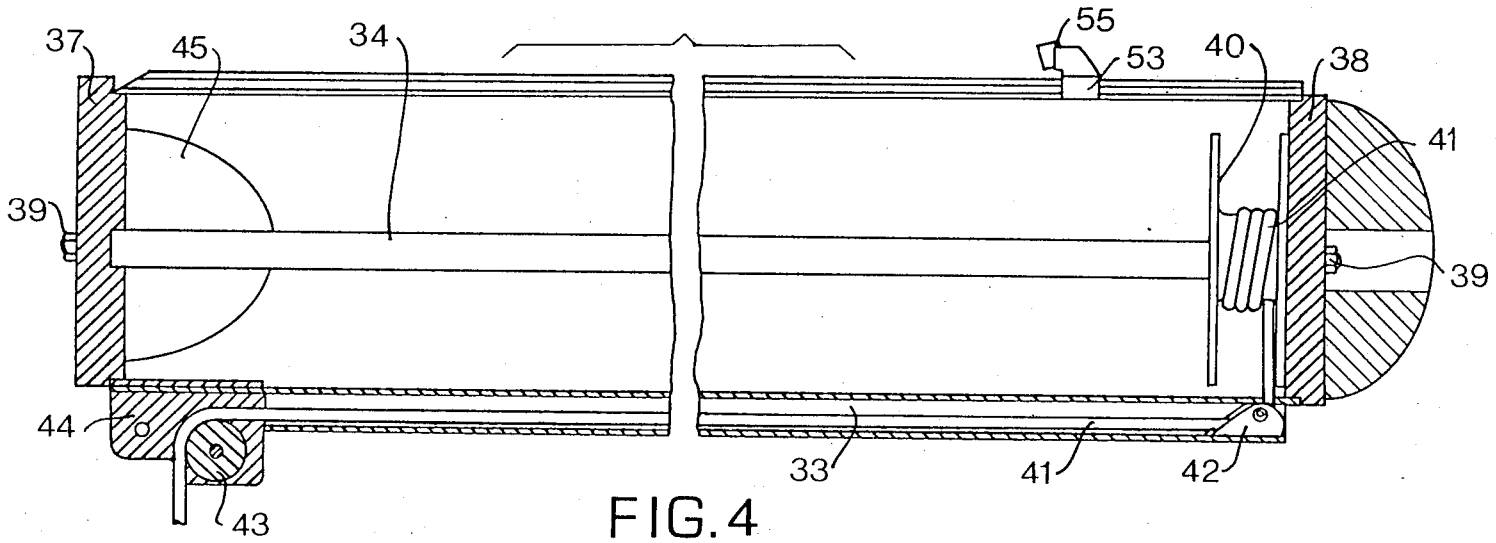
FIG. 4 is a sectional view of the rotatable boom shown in FIG. 1 illustrating the reefing mechanism.
Figure 5:
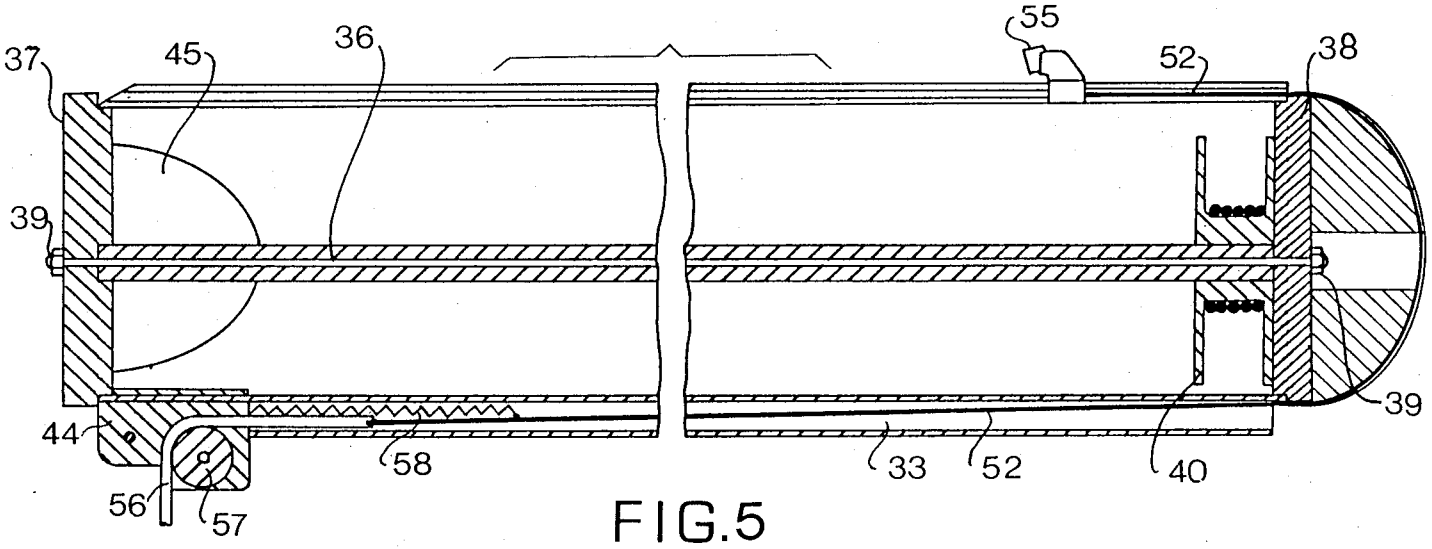
FIG. 5 is a sectional view of the rotatable boom shown in FIG. 1 and illustrating the outhaul and boom cover mechanism.
Figure 6:
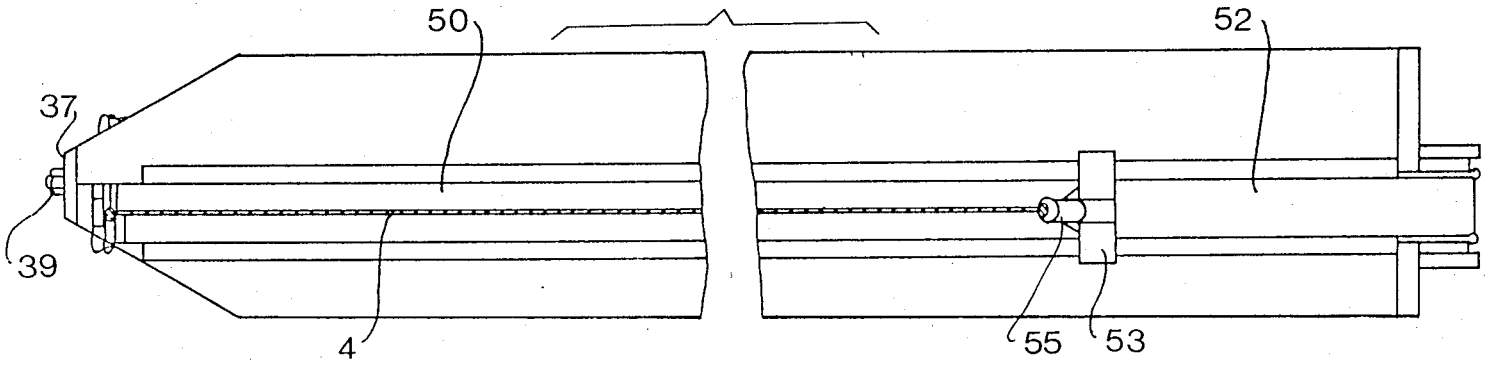
FIG. 6 is a top view of the rotatable boom shown in FIG. 1.

The tube 30 is closed at its ends by end plates 37 and 38. The wire rod 36 extends through the end plates 37 and 38 and is tensioned by mutters 39 which are screwed onto threaded ends of the wire rod 36. A reefing drum 40 is attached to the rod 34 at the end remote from the mast 1 and as will appear from FIG. 4, a rope 41 is wound on the drum 40. The rope 41 passes around two rope sheaves 42 and 43, of which the former is located in the compartment 33 and the latter is mounted in a goose neck bracket 44 at the opposite end of the boom arrangement 8. At the front end of the tube 30 the sides of the tube are cut off at an angle of about 45° relative to the axis of the tube so as to form openings 45 therein.

Figure 3:
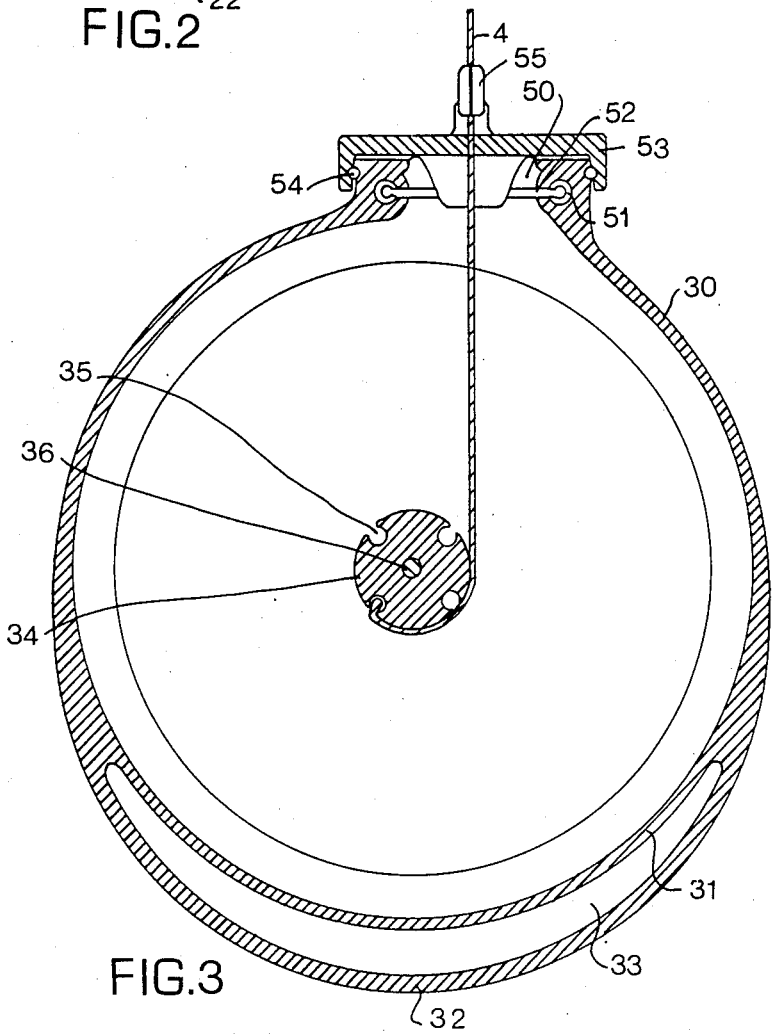
FIG. 3 is a cross-sectional view of the rotatable boom illustrated in FIG. 1.

As will appear from FIG. 3 the upper part of the tube 30 comprises a slot 50 which is laterally offset relative to the rotatable rod 34. The longitudinal edges of the slot 50 comprise grooves 51, and a combined outhaul and slot cover ribbon 52 is mounted axially displaceably in the grooves 51. One end of the ribbon 52 is connected with an outhaul slider 53 which is mounted slidably over the slot 50 by means of steel ball bearings 54. A leech feeder 55 for the leech 6 of the sail 4 is secured to the outhaul slider 53. The ribbon 52 passes around the free end of the boom arrangement 8 by following a curved path provided thereon and extends into the separate compartment 33 in which it is connected with an outhaul rope 56 passing around a sheave 57 mounted in the goose neck bracket 44. A spring 58 having one end attached to the goose neck bracket 44 and the opposite end to the ribbon 52 serves to move the outhaul slider 53 and consequently the leech feeder 55 rearwardly when the sail is unrolled from the boom.

The reefing of the sail 4 is effected by hauling the rope 41 which will cause the drum 39 and consequently the rod 34 to rotate and by simultaneously loosening the sail halyard. The rotation of the rod 34 will cause the sail to roll down and to be wound on the rod 34. At the same time the leech feeder 55 will move towards the mast and casue the outhaul slider 53 to move in the same direction, thus gradually causing the slot 50 to be covered by the ribbon 52. After the desired reefing has been effected, the outhaul rope 56 is fastened in taut condition so as to stretch the sail.

The leech feeder 10 mounted on the mast 1 will guide the front edge of the sail 4 comprising the folded ribbon 40 into the tube 30 where it will be wound on the front end of the rod 34.

If it is desired to counteract any undesired changes of the shape of sail during reefing fillers, elements of a foamed plastic material may be secured to the grooves 35 of the rotatable rod 34.

We claim:

1. In a rig for a sail-carrying boat which includes a mast, a boom which is pivotally connected to the mast and a sail which has a luff, a leech and a bottom edge, the improvement wherein said boom comprises a tubular body which extends from a first end near the mast to a second end remote from the mast and is defined by a top portion and a bottom portion, said tubular body including a longitudinal slot in its upper portion through which said sail can extend into a chamber formed therein, a bracket pivotally connecting the first end of said tubular body to said mast, a first end plate positioned over the first end of said tubular body, said first end plate including a hole therein, a second end plate positioned over the second end of said tubular body, said second end plate including a hole therein, a shaft which extends through the chamber in said tubular body and through said holes in said first and second end plates, means for tensioning said shaft between said first and second end plates and for pressing said first and second end plates against said tubular body, and a hollow rod rotatably positioned around said shaft, the bottom edge of said sail being attached to said hollow rod so that rotation of said hollow rod around said shaft during reefing will cause said sail to be wrapped therearound and become reefed.

2. A rig as claimed in claim 1, wherein said hollow rod includes an axially-extending groove in which the bottom edge of said sail is secured.

3. a rig as claimed in claim 1, wherein said longitudinal slot in the top portion of said tubular body is laterally offset relative to said shaft therein.

4. A rig as claimed in claim 1, wherein said tubular body provides axially-extending grooves on the respective opposite sides of said longitudinal slot therein, wherein a ribbon is mounted in said grooves to be movable therealong, wherein an outhaul slider is connected to a first end of said ribbon so as to be movable along said tubular body with said one end of said ribbon, wherein a leech feeder is connected to said outhaul slider, said leech feeder being slidingly attached to the leech of said sail, and wherein an outhaul rope is connected to a second end of said ribbon, whereby reefing of said sail causes said leech feeder, said outhaul slider and said ribbon to move along said tubular body toward said first end thereof, thereby said ribbon covering said slot.

5. A rig as claimed in claim 4, including a spring connected to said second end of said ribbon to bias said ribbon such that it uncovers said slot.

6. A rig as claimed in claim 4, wherein said bottom portion of said tubular body provides an axial compartment which is separate from said chamber, and wherein said outhaul rope extends into and along said axial compartment.

7. A rig as claimed in claim 6, including a reefing drum located in said chamber and connected to said shaft adjacent said second end plate and a rope extending from said reefing drum to and along said axial compartment to said bracket and then downwardly and away from said tubular body.

* * * * *